US012668989B2

(12) United States Patent
Schneider et al.

(10) Patent No.: US 12,668,989 B2
(45) Date of Patent: Jun. 30, 2026

(54) BOARD CLEAT APPARATUS AND METHOD FOR MIXED MATERIAL HORIZONTAL ALUMINUM FENCE

(71) Applicant: Barrette Outdoor Living, Inc., Middleburg Heights, OH (US)

(72) Inventors: Christopher Michael Schneider, Linwood, NJ (US); Patrick Joseph Bertke, Mays Landing, NJ (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 275 days.

(21) Appl. No.: 18/497,128

(22) Filed: Oct. 30, 2023

(65) Prior Publication Data

US 2024/0141685 A1 May 2, 2024

Related U.S. Application Data

(60) Provisional application No. 63/420,386, filed on Oct. 28, 2022.

(51) Int. Cl.
*E04H 17/16* (2006.01)
*E04H 17/14* (2006.01)

(52) U.S. Cl.
CPC ..... *E04H 17/168* (2013.01); *E04H 17/1456* (2021.01)

(58) Field of Classification Search
CPC . E04H 17/14; E04H 17/1447; E04H 17/1452; E04H 17/1456; E04H 17/1488;
(Continued)

(56) References Cited

U.S. PATENT DOCUMENTS 4,007,919 A * 2/1977 Totten ..... E04H 17/1413 256/65.13
4,047,703 A * 9/1977 Murdock ..... E04H 17/1413 403/244

(Continued)

FOREIGN PATENT DOCUMENTS

CA 2198511 A1 * 8/1998 ..... E04H 17/006
CA 2806405 A1 * 8/2013 ..... E04H 17/168

(Continued)

OTHER PUBLICATIONS

Canadian Office Action mailed Feb. 24, 2025 issued in connection with corresponding Canadian Patent Application No. 3,217,949 (5 pages total).

*Primary Examiner* — Jonathan P Masinick
(74) *Attorney, Agent, or Firm* — John Maldjian, Esq.; Stevens & Lee PC

(57) ABSTRACT

A system includes a board at an initial position. The system also includes a first connecting apparatus positioned at one end of the boards. The first connecting apparatus includes a front end configured to be positioned within an opening of the board and a bottom end configured to be positioned within a fence structure. The system also includes a second connecting apparatus positioned at another end of the board. The second connecting apparatus includes a front end configured to be positioned within another opening of the board and a bottom end configured to be positioned within the fence structure. The system also includes a plurality of corner posts configured to receive the first connecting apparatus and the second connecting apparatus.

19 Claims, 10 Drawing Sheets

(58) Field of Classification Search
CPC ..... E04H 17/16; E04H 17/168; E04H 17/17; E04H 17/1413; E04H 17/1465; E04H 17/1469
See application file for complete search history.

(56) References Cited

U.S. PATENT DOCUMENTS

| | | | | |
|---|---|---|---|---|
| 7,690,629 | B1 * | 4/2010 | Briggs | E04H 17/168 256/65.12 |
| 8,511,648 | B2 * | 8/2013 | McCarthy | E04H 17/1404 256/65.01 |
| 10,253,524 | B2 * | 4/2019 | Schneider | E04H 17/1488 |
| 10,301,842 | B2 * | 5/2019 | Volin | E04H 17/1417 |
| 10,718,133 | B1 * | 7/2020 | Maher | E04H 17/165 |
| 10,975,592 | B2 * | 4/2021 | Smith | E01F 15/0484 |
| 11,746,559 | B2 * | 9/2023 | Amsellem | E06B 11/02 256/34 |
| 11,891,832 | B2 * | 2/2024 | Schneider | E04H 17/1456 |
| 2003/0213947 | A1 * | 11/2003 | Takagi | E04H 17/1413 256/65.02 |
| 2006/0113517 | A1 * | 6/2006 | Colantonio | E04H 17/168 256/24 |
| 2007/0158628 | A1 * | 7/2007 | Tsao | E04H 17/1465 256/19 |
| 2013/0092473 | A1 * | 4/2013 | Humphries | E04H 17/168 181/285 |
| 2017/0058557 | A1 * | 3/2017 | Wu | E04H 17/22 |
| 2017/0211272 | A1 * | 7/2017 | Cullinan | E04H 17/1413 |
| 2023/0212875 | A1 * | 7/2023 | Walker | E04H 17/168 256/24 |
| 2024/0141682 | A1 * | 5/2024 | Heritage | E04H 17/1452 |
| 2024/0141683 | A1 * | 5/2024 | Schneider | E04H 17/1465 |
| 2024/0141685 | A1 * | 5/2024 | Schneider | E04H 17/1447 |
| 2024/0141686 | A1 * | 5/2024 | Schneider | E04H 17/168 |
| 2025/0092714 | A1 * | 3/2025 | Lo | E04H 17/1447 |
| 2025/0172012 | A1 * | 5/2025 | Fitzgerald | E04H 17/1488 |

FOREIGN PATENT DOCUMENTS

| | | | | |
|---|---|---|---|---|
| CN | 110331682 | A | 10/2019 | |
| DE | 10146517 | C1 * | 3/2003 | E04H 17/168 |
| DE | 102012100567 | A1 * | 5/2013 | E01F 8/0011 |
| DE | 202012103687 | U1 * | 11/2013 | E04H 17/1413 |
| DE | 202014000716 | U1 * | 2/2014 | E04H 17/20 |
| DE | 202013011807 | U1 * | 9/2014 | D04H 11/00 |
| DE | 102020100493 | A1 * | 7/2021 | E06B 11/02 |
| EP | 2884004 | A2 * | 6/2015 | E04H 17/20 |
| EP | 3399123 | A1 * | 11/2018 | E04H 17/168 |
| FR | 3032003 | B1 * | 1/2017 | |
| FR | 3041014 | B3 * | 10/2017 | |
| FR | 3041013 | B1 * | 5/2018 | E04H 17/22 |
| GB | 1536546 | A * | 12/1978 | E04H 17/20 |
| GB | 2352740 | A * | 2/2001 | E04H 17/168 |
| JP | 11172643 | A * | 6/1999 | |
| KR | 102024717 | B1 * | 9/2019 | E04H 17/1413 |
| KR | 102610183 | B1 * | 12/2023 | E04H 17/1448 |

* cited by examiner

BOARD CLEAT APPARATUS AND METHOD FOR MIXED MATERIAL HORIZONTAL ALUMINUM FENCE

CROSS REFERENCE TO RELATED APPLICATION

This application claims benefit and priority to U.S. Provisional Application Ser. No. 63/420,386, filed Oct. 28, 2022, entitled, "BOARD CLEAT APPARATUS AND METHOD FOR MIXED MATERIAL HORIZONTAL ALUMINUM FENCE" which is incorporated herein by reference in its entirety.

FIELD OF INVENTION

The present disclosure generally relates a board cleat apparatus to enable a mixed material horizontal aluminum fence to be part of a fence structure.

BACKGROUND

Fence structures will often not have the aesthetic enhancement that is often desired. Further, fence structures may often also not have the structural enhancement desired as well. Further, when an aesthetic appeal is added to the fence structure, often times the structural support can be compromised as a result.

In addition, fence structures can typically have materials made of the same material or substantially similar material. The posts of the fence structure and also the boards of the fence structure will often be made of substantially similar materials. As such, users or owners of such fence systems may have a fence system that lacks aesthetic appeal.

Fence owners may not know how to make it structurally possible within the fence structure to receive various boards that provide the aesthetic appeal but will also be structurally supported within the fence structure. The posts within the fence system may not be able to receive boards of different materials. As a result, the fence system can be thereby limited to only receiving boards of a same material or with boards that simply lack aesthetic appeal.

Accordingly, to enable the fence structure to have boards that have aesthetic appeal but are also structurally supported, the fence structure or system needs to have additional structure or structures in place to structurally support the type of boards that can provide enhanced aesthetic appeal to the fence system. Further, the fence structure needs to have an efficient system of securing the various boards in their positions within the fence structure.

SUMMARY

The following summary is provided to facilitate an understanding of some of the features of the disclosed embodiments and is not intended to be a full description. A full appreciation of the various aspects of the embodiments disclosed herein can be gained by taking the specification, claims, drawings, and abstract as a whole.

The aforementioned aspects and other objectives can now be achieved as described herein.

In an embodiment, a system includes a board configured at an initial position. The system also includes a first connecting apparatus positioned at one end of the board. The first connecting apparatus includes a front end that is configured to be positioned within an opening of the board and a bottom end configured to be positioned within a fence structure. The system also includes a second connecting apparatus positioned at another end of the board. The second connecting apparatus includes a front end configured to be positioned within another opening of the board and a bottom end configured to be positioned within the fence structure.

In the system, a plurality of corner posts are configured to receive the board connected to the first connecting apparatus and the second connecting apparatus.

In the system, a plurality of corner posts include a front set of ribs and a back set of ribs to enable the first connecting apparatus to be positioned within the fence structure.

In an embodiment, a system includes a board configured at a first position. The system also includes a connecting apparatus configured at a second position. The connecting apparatus includes a front end and a back end. The front end is configured to be positioned within a front portion of the board while the back end is configured to be positioned within a fence structure. The system also includes a corner post positioned within the fence structure. The corner post includes a front set of ribs and a back set of ribs to receive the back end of the connecting apparatus.

In the system, the front end of the connecting apparatus is positioned in an opening within the board.

In the system, the board is partially positioned within a front portion of the corner post.

In an embodiment, a method includes configuring a board at an initial position. The method also includes positioning a first connecting apparatus at one end of the board. The first connecting apparatus includes a front end that is configured to be positioned within an opening of the board and a bottom end that is configured to be positioned within a fence structure. The method also includes configuring a second connecting apparatus at another end of the board. The second connecting apparatus includes a front end configured to be positioned within another opening of the board and a bottom end configured to be positioned within the fence structure. The method also includes positioning a plurality of corner posts to receive the first connecting apparatus and the second connecting apparatus.

The method also includes positioning the second connecting apparatus in a position opposite to the first connecting apparatus to receive another end of the board.

The method also includes positioning the second connecting apparatus into one of the plurality of corner posts within the fence structure.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The above and still further features and advantages of embodiments of the present invention will become apparent upon consideration of the following detailed description of embodiments thereof, especially when taken in conjunction with the accompanying drawings, and wherein.

Figure 1A:
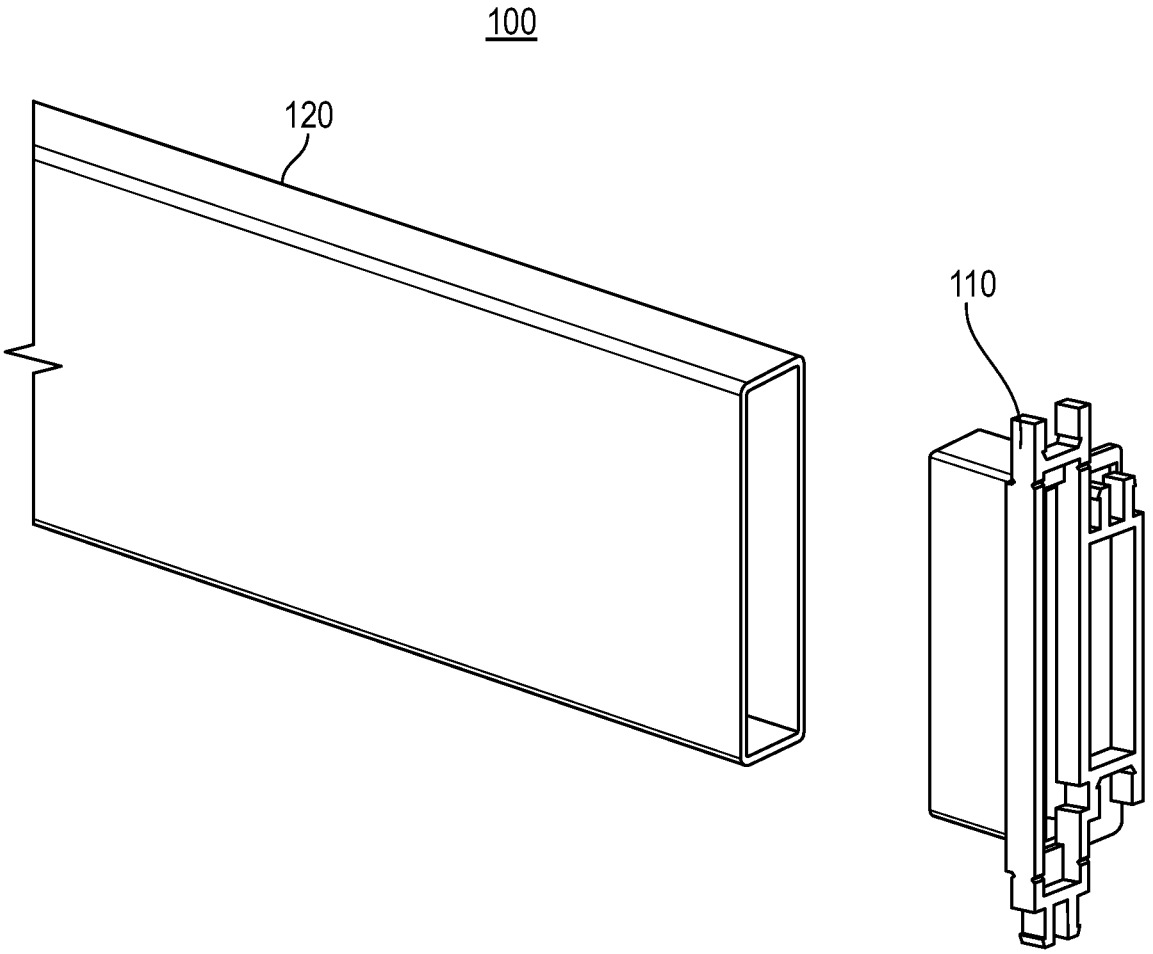
FIG. 1A illustrates a board and board cleat apparatus in accordance with an embodiment of the invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to.

To facilitate understanding, like reference numerals have been used, where possible, to designate like elements common to the figures. Optional portions of the figures may be illustrated using dashed or dotted lines, unless the context of usage indicates otherwise.

DETAILED DESCRIPTION

A fence structure can have an enhanced aesthetic appeal while retaining structural integrity throughout the fence structure. In other words, the aesthetic appeal of the fence structure can be enhanced without reducing the structural support required for the boards to remain secured within the fence structure Within the fence structure, a variety of corner posts can be used to support the set of boards. In one or more embodiments, the corner posts can be used to receive a plurality of boards within the fence system. Moreover, to enable the boards to be positioned within the fence system, a series of cleat board apparatuses are used within the fence system to enable the boards to be secured within each corner post in the fence system.

An initial board will include an opening on each end of the board. A front end of the respective board cleat apparatus will be positioned within the opening on an end of the board. Once the board and board cleat apparatus are connected, the back end and bottom end of the board bleat apparatus can be positioned within a corner post.

The corner post will include a front set of ribs and a back set of ribs. The back set of ribs will be positioned behind the front set of ribs. The interconnected structure of the board and board cleat apparatus will be placed within the back set of ribs. In various embodiments, the back end and bottom end of the board cleat apparatus will be in contact with a back end of the corner post. The front portion of the board will be placed within the front set of ribs and back set of ribs within the corner post.

Once one end of the board is secured within the corner post and attached to the board cleat apparatus, another end of the board can be connected to the corner post using the same method described above. Another board cleat apparatus at the other end of the board will be placed in an opening at the other end of the board. The other end of the board will then be connected to the other board cleat apparatus.

When the other end of the board is positioned within the other board cleat apparatus, the connected structures will then be placed into the corner post at the opposite end of the fence system. The opposite corner post will have the same structural features as the initial corner post.

The other end of the board connected to the other board cleat apparatus will be placed within the front set of ribs and back set of ribs within the opposite corner post. The back end and bottom end of the board cleat apparatus will extend to a back end of the opposite corner post. The front end of the other end of the board will be positioned within the front set of ribs and back set of ribs within the opposite corner post.

The remaining boards can be positioned underneath the initial board. Each board is positioned horizontally within the fence system. Each corner post will receive the board cleat apparatus and the horizontal boards. The horizontal boards can be made of aluminum materials.

When the boards and board cleat apparatuses throughout the fence system are secured, a top aluminum rail can be placed over the boards. Portions of the structure underneath the corner posts can also include aluminum rail materials.

The board cleat apparatuses throughout the fence system enable the boards to be placed within the fence system. The front end of each board cleat apparatus will be configured to be positioned within the opening of the end of the board. The back end of each board cleat apparatus enables the board to be positioned within the front set of ribs and back set of ribs within the corner post. The remaining boards can thereby be placed within each corner posts. Each board cleat apparatus enables the boards to be placed within the fence system.

The aesthetic appeal of the fence system is enhanced by the boards that are structurally supported by the corner posts and the board cleat apparatuses. The contrast between the aluminum frames at the top portion of the structure and the boards will enhance the aesthetic appeal. The corner posts and board cleat apparatus will provide the structural support throughout the fence system.

Figure 1B:
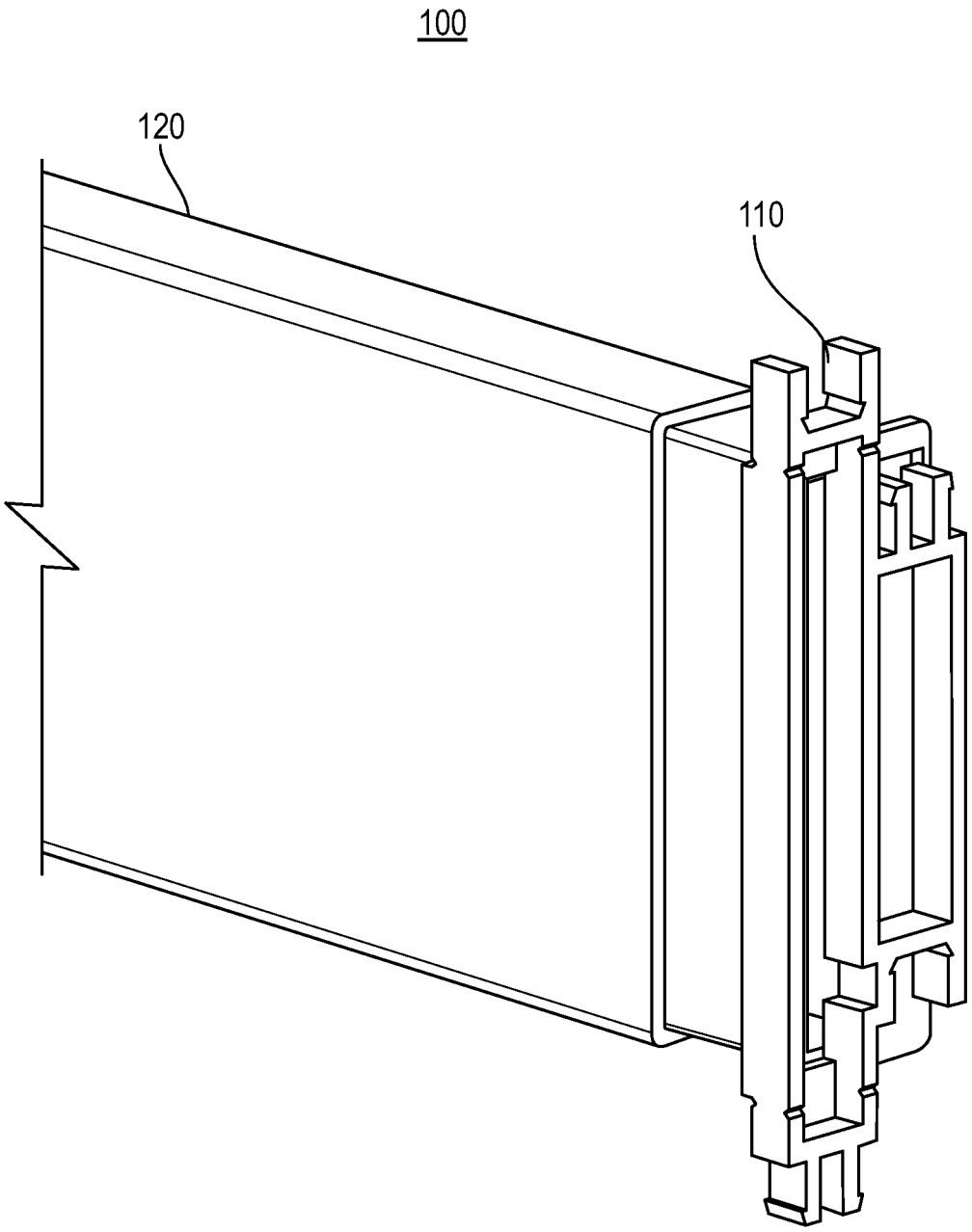
FIG. 1B illustrates another view of the board and board cleat apparatus in accordance with an embodiment of the invention.

FIGS. 1A-1B illustrate different ends of an aluminum board and board cleat apparatus. Both the board and board cleat apparatus will be part of a fence structure along with the aluminum frames on the top portion of the fence structure.

Referring to FIG. 1A, a portion of a fence system 100 is illustrated. The fence system 100 includes a board cleat apparatus 110 and a board 120. The board 120 can be made of aluminum materials in one or more embodiments. The board cleat apparatus HO can enable the aluminum board 120 to be positioned within the fence system 100. The board cleat apparatus 110 will have a front end and back end that are positioned within the board 120 and fence system 100 respectively. Each end of the board 120 will include an opening to receive the board cleat apparatus 110 and another board cleat apparatus at the opposite end of the hoard 120. The front end of the board cleat apparatus 110 will be positioned within an opening within the board 120. The board cleat apparatus HO will enable the board 120 to be part of the fence system 100 by enabling the front portion of the board 120 to be positioned within a corner post within the fence system 100.

In FIG. 1B, the fence system 100 is shown with the board cleat apparatus HO connected to board 120. As mentioned above, the board cleat apparatus 110 will be positioned within the opening of the board 120 to enable the board cleat apparatus 110 to be connected to the board 120. Once the board cleat apparatus 110 and board 120 are interconnected within the same structure, both the board cleat apparatus 110 and the board 120 can then be positioned within a corner post within the fence system 100. In addition, the other end of the board 120 will also be connected to another board cleat apparatus. As such, the other end of the board 120 will be positioned within the other end of the fence system 100 using the same method in one or more embodiments. The board cleat apparatus 110 will enable the board 120 consisting of aluminum materials to be pail of the fence system 100. Moreover additional aluminum boards can be positioned underneath the board 120 within the fence system 100.

Figure 2A:
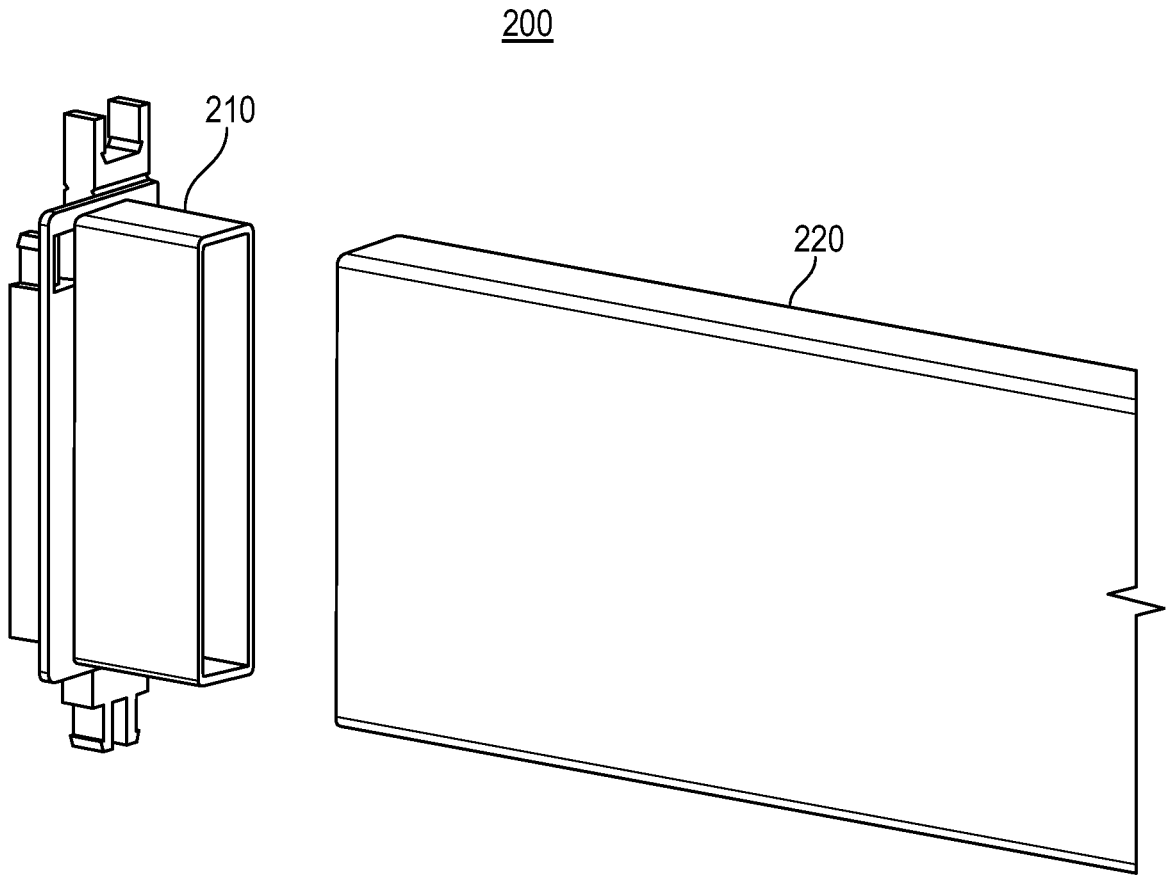
FIG. 2A illustrates another view of a board and board cleat apparatus corner post in accordance with an embodiment of the invention.

Referring to FIG. 2A, another illustration of the fence system 200 is shown. Moreover, illustration of another end of the board 220 being positioned within another board cleat apparatus 210 is shown. In particular, another board cleat apparatus 210 is illustrated next to another end of the board 220. As in FIGS. 1A and 1B, the board 220 can be made of aluminum materials. The board 220 includes an opening within its front end to receive the board cleat apparatus 210. Accordingly, the front end of the board cleat apparatus 210 is configured to be positioned within an opening in the board 220. The back end and bottom end of the board cleat apparatus 210 will be configured to be positioned within the fence system 200 within a corner post with a front set of ribs and a back set of ribs. The back end of the board cleat apparatus 210 can be positioned within the fence system 200 when the board cleat apparatus 210 is connected to the board 220. To be part of the fence system 200, the front end of the board cleat apparatus 210 is positioned within the opening of the board 220. The front end of the board 220 is positioned within the corner post along with the board cleat apparatus 210.

Figure 2B:
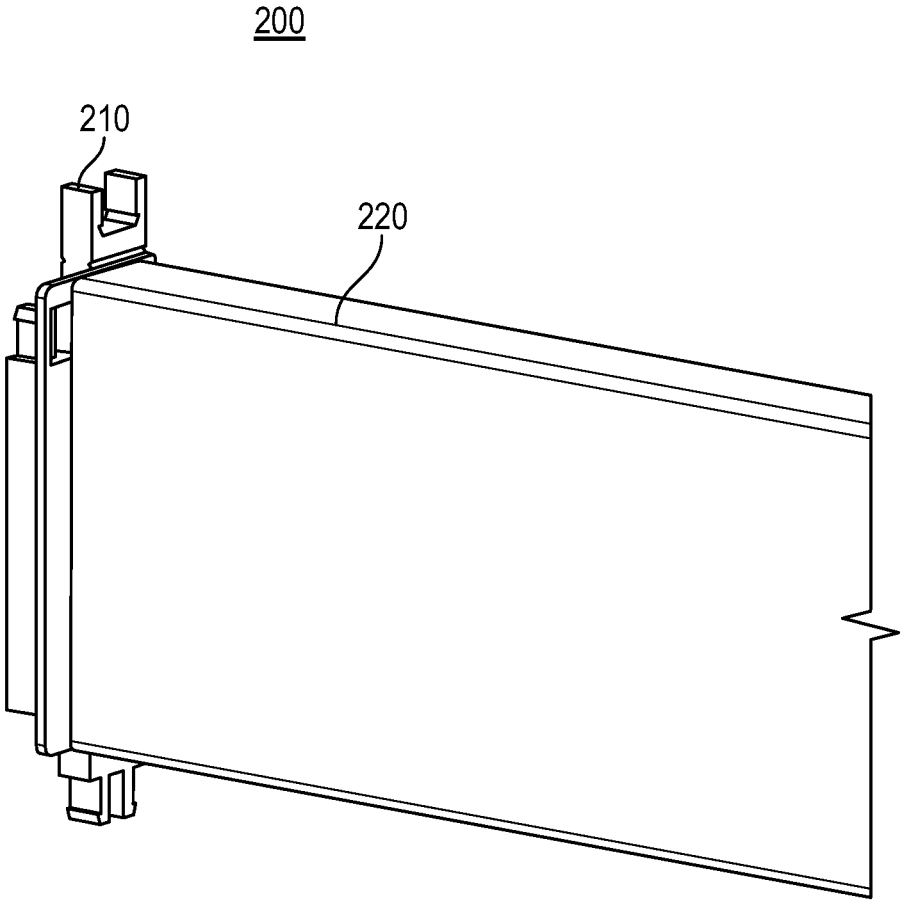
FIG. 2B depicts a further view of the board and board cleat apparatus in accordance with an embodiment of the invention.

In FIG. 2B, a further illustration of the fence system 200 is shown. The board cleat apparatus 210 is secured within the opening of the board 220. The user can simply place the board cleat apparatus 210 within the opening of the board 220. When the board cleat apparatus 210 is connected to the board 220, both the board cleat apparatus 210 and board 220 can be placed within a corner post to be part of the fence system. The board cleat apparatus 210 can be secured through the front and back set of ribs and onto a back end of the corner post. The front end of the board 220 can be positioned within the front set of ribs and back set of ribs within the corner post. The board cleat apparatus 210 ensures that the board 220 consisting of aluminum materials is part of the fence system 200 with other aluminum boards that are positioned horizontally beneath the board 220 within the fence system 200.

Figure 3A:
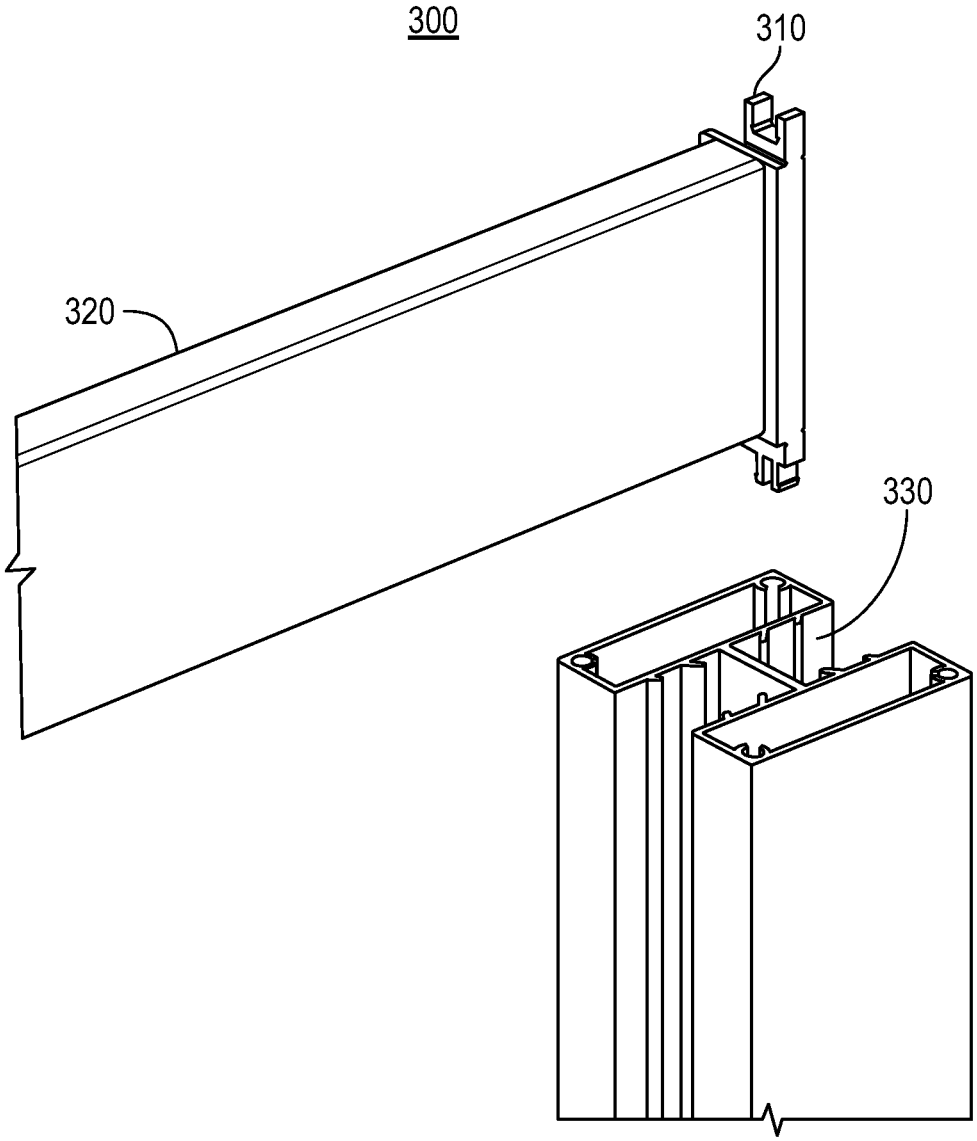
FIG. 3A depicts the board, board cleat apparatus, and corner post in accordance with an embodiment of the invention.

Referring to FIG. 3A, the fence system 300 is illustrated where a connected board cleat apparatus 310 and board 320 are positioned above a corner post. The corner post will be positioned at each end of the board and board cleat apparatus within the fence system 300.

In FIG. 3A, the board cleat apparatus 310 is connected to the board 320. The hoard 320 is made of aluminum materials. The interconnected structure of the board cleat apparatus 310 and the board 320 can be positioned within the corner post 330 to be part of the fence system 300. The corner post 330 can include a front set of ribs and a back set of ribs. The combined board cleat apparatus 310 and board 320 can be placed within the front and back set of ribs within the corner post 330 to be part of the fence system 300. The user can lower the connected hoard cleat apparatus 310 and hoard 320 into the corner post 330 below. The board cleat apparatus 310 enables the board 320 to be positioned within the corner post 330.

Figure 3B:
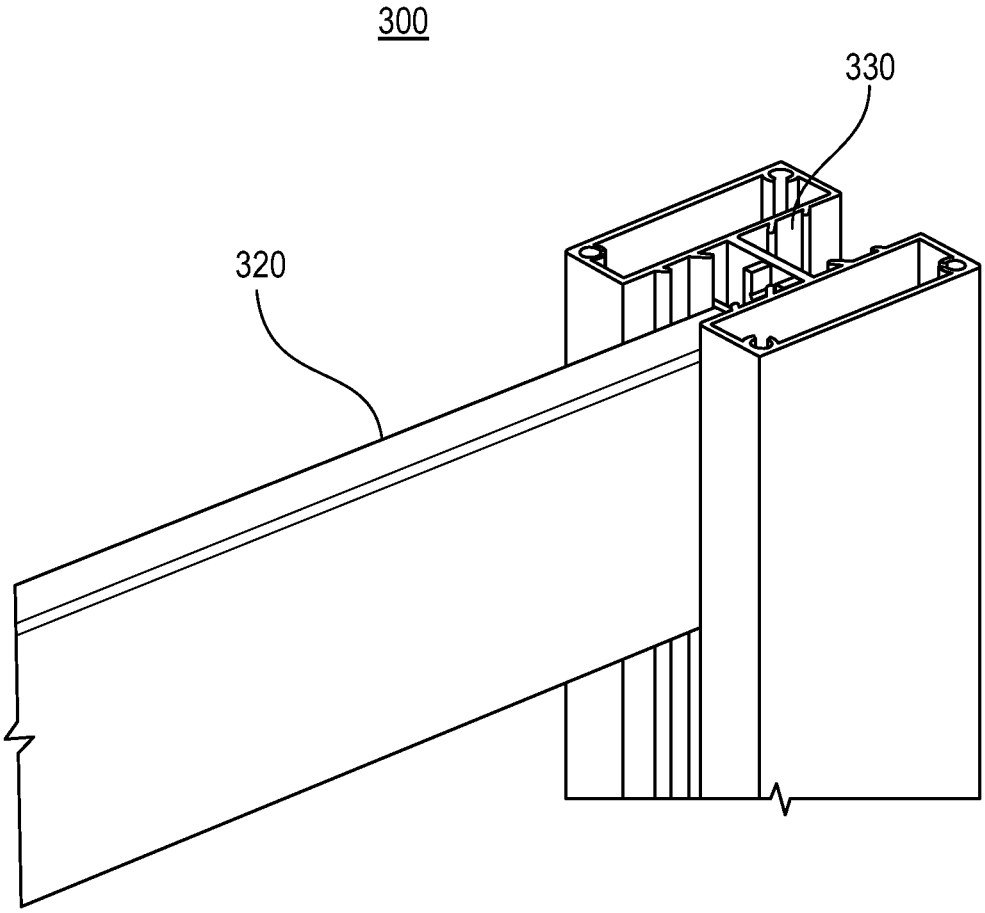
FIG. 3B illustrates another view of the board, board cleat apparatus, and corner post in accordance with an embodiment of the invention.

Referring to FIG. 3B, another illustration of the fence system 300 is shown. In this illustration, the board 320 with the hoard cleat apparatus 310 is positioned within the corner post. The board cleat apparatus 310 can be positioned within a front set of ribs and a back set of ribs within the corner post 330. In addition, a front portion of the board 320 is also positioned within the front set of ribs and back set of ribs within the corner post 330. The board cleat apparatus 310 can also extend past the front set of ribs and hack set of ribs within the corner post 330 and onto a hack end of the corner post 330. Moreover, once one end of the board 320 and board cleat apparatus 310 are secured within the corner post 330, another end of the board 320 can be secured within another hoard cleat apparatus at the opposite end of the fence system 300. Further, the other end of the board 320 and other board cleat apparatus can be secured within another corner post within the fence system 300.

Figure 3C:
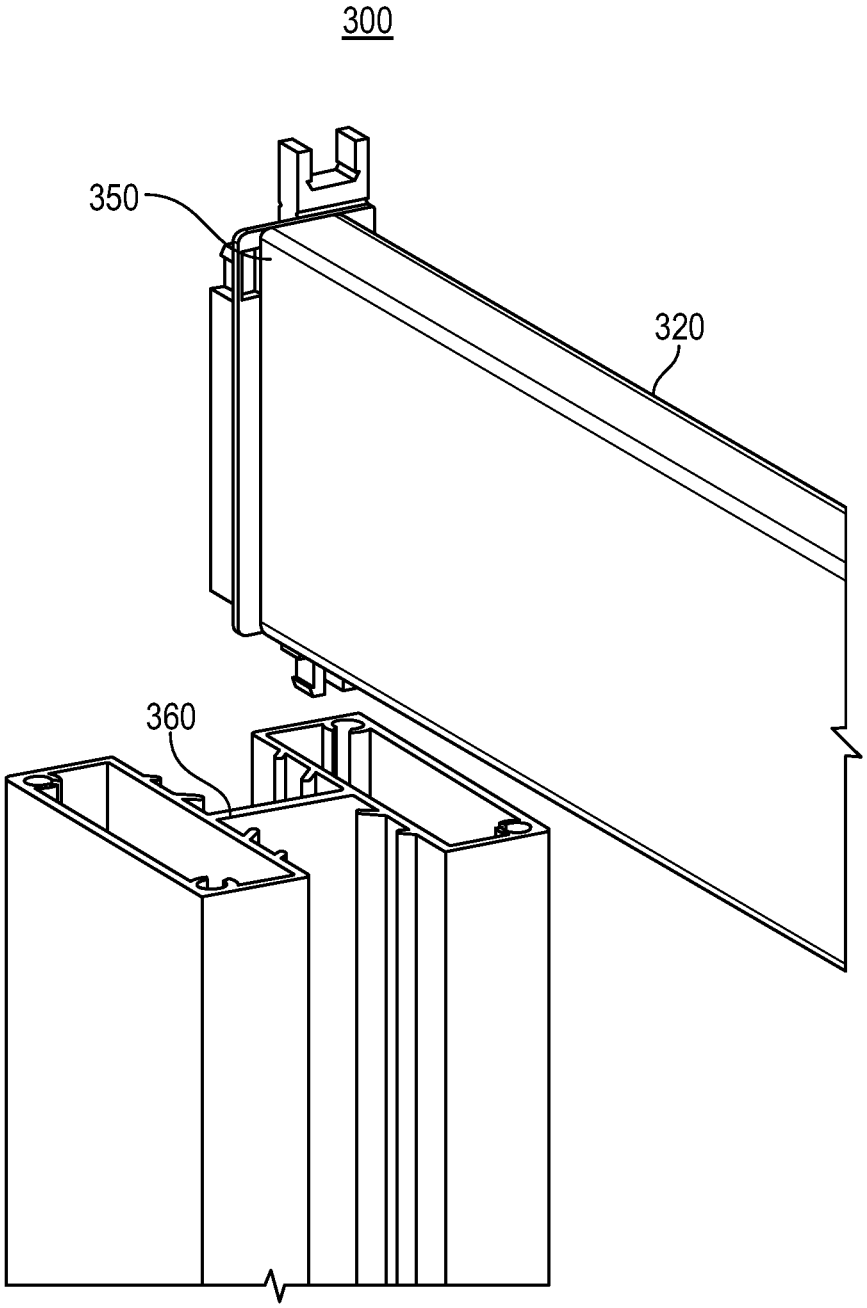
FIG. 3C depicts the board, board cleat apparatus, and corner post according to an embodiment of the invention.

In FIG. 3C, a further illustration of the fence system 300 is shown. Another end of the hoard 320 is secured within another board cleat apparatus 350. The connected board cleat apparatus 350 and board 320 are positioned above a corner post 360 at the opposite end of the fence system 300. The user can lower the combined structure into the corner post 360. The combined structure of the board 320 and board cleat apparatus 350 are positioned within the additional corner post 360. The corner post 360 includes a front set of ribs and a hack set of ribs. The board 320 and hoard cleat apparatus 350 will be positioned within the front set of ribs and back set of ribs within the corner post 360. Moreover, the front portion of the board 320 will be positioned onto a hack set of ribs within the corner post 360. The board cleat apparatus 350 can extend onto the back end of the corner post 360.

Figure 3D:
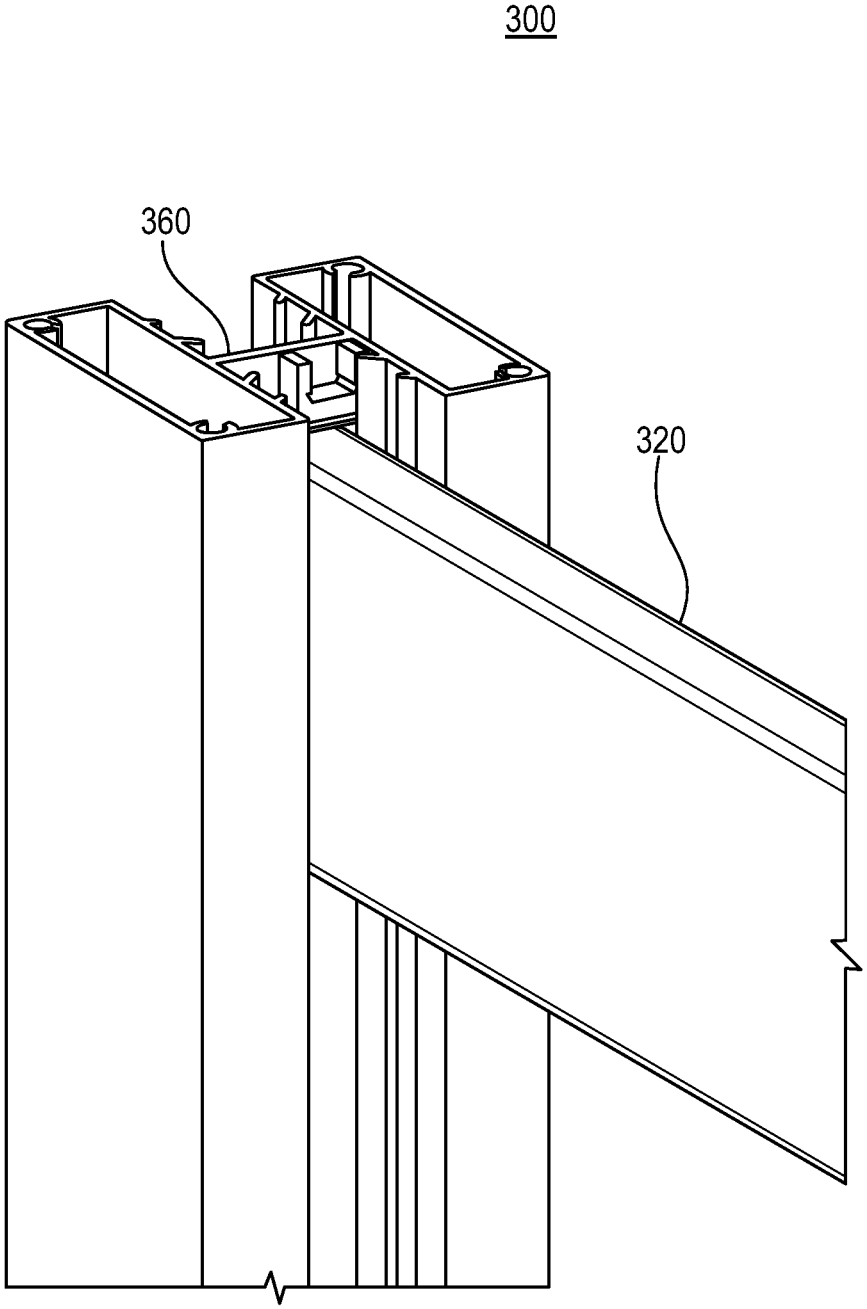
FIG. 3D illustrates a further view of the board, board cleat apparatus, and corner post according to an embodiment of the invention.

Referring to FIG. 3D, an illustration of the fence system 300 is shown in which the board 320 and board cleat apparatus 350 are positioned within the corner post 360. The interconnected structure of the board 320 with the board cleat apparatus 350 are positioned within the front set of ribs and the back set of ribs within the corner post 360. Moreover, the board cleat apparatus 350 can extend past both the front set of ribs and back set of ribs onto a back end of the corner post 360. The front end of the board 320 can be positioned within the back set of ribs within the corner post 360. Once both ends of the board 320 are secured within both board cleat apparatus' 310, 350, the board and board cleat apparatuses 310, 350 can be secured within both corner posts 330, 360. Further, additional aluminum boards can be positioned underneath the board 320 and in between the corner posts 330, 350 within the corner posts within fence system 300. Moreover, other additional corner posts within the system can receive board cleat apparatuses and other horizontal aluminum boards with the same process illustrated in FIGS. 3A-3D.

Figure 4:
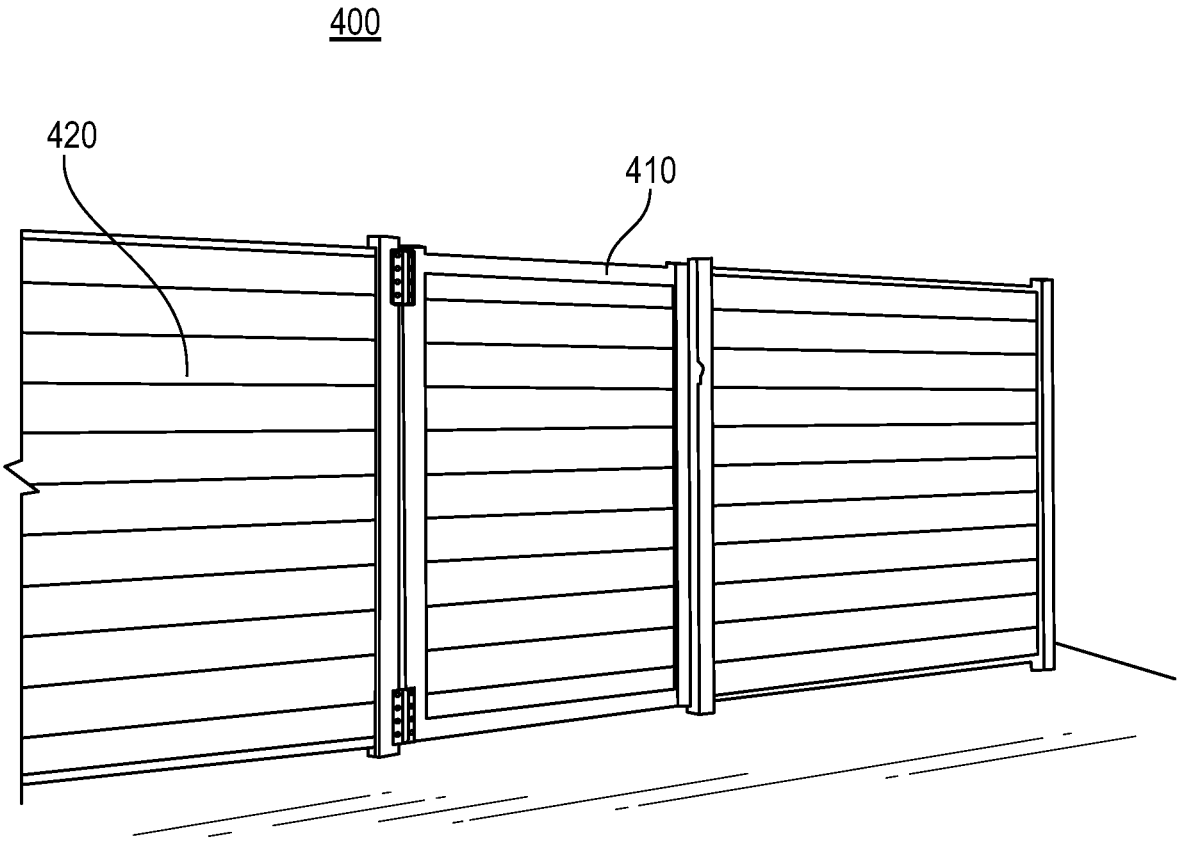
FIG. 4 depicts a completed fence system in accordance with an embodiment of the invention.

In FIG. 4, a completed fence system 400 is illustrated. The fence system 400 can be completed using the process described above in the previous figures. An aluminum rail 410 and boards 420 are illustrated. An initial board among the boards 420 can be connected with a board cleat apparatus at each end of the board. In particular, the respective board cleat apparatus will be positioned within an opening of the board. Both ends of the initial board will include an opening to receive a respective board cleat apparatus. The interconnected board and board cleat apparatus on each end of the hoard can be positioned within a corner post within the fence system 400. Each corner post can have a front set of ribs and a back set of ribs. The interconnected board and cleat board apparatus will be positioned within the front set of ribs and back set of ribs within each corner post. In addition, the board cleat apparatus can also extend to a back end of each corner post past the front set of ribs and back set of ribs. The front set of initial board can extend onto the back set of ribs within the corner post. The additional boards 420 can also be placed underneath or above the original board that is connected to a cleat board apparatus within each corner post.

Referring to FIG. 4, a top aluminum frame 410 is positioned after each board 420 is positioned within the corner posts. The aluminum frame 410 can be positioned over a top board among the boards 420 and around the corner posts within the fence system 400. The aluminum frame can complete the fence system 400. The board cleat apparatus on both ends of at least one of the boards 420 enable the boards 420 to be placed within the corner posts within the fence system. The boards 420 can be placed underneath the initial board positioned with the board cleat apparatus and the corner post. The boards 420 will be secured within the corner post on both ends. The user can position as many corner posts and boards 420 as are needed within the fence system 400.

In FIG. 4, the board cleat apparatuses within the fence system 400 enable the boards 420 to be positioned within the corner posts of the fence system 404). The board cleat apparatus on each end will be placed within an opening of a board. Once a board and the board cleat apparatus are connected, the back end of the board cleat apparatus can be placed within the front and back set of ribs within the corner posts. A front portion of the board can be placed within each corner post as well. The additional boards 420 can then be placed underneath the original board. The board cleat apparatus on each end of the original board enables the boards 420 to be positioned within the corner posts within the fence system 400. The front portion of each board cleat apparatus is able to be positioned in the opening of a board. The back end of each board cleat apparatus can be positioned within a back end of each corner post and also the front and back set of ribs within each corner post. As such, the fence system 400 can be a fence system 400 with the boards 420 and also the aluminum frames 410 over the boards 420. The board cleat apparatuses enable the boards to be secured in between each corner post. The fence system 400 has the structural support from the board cleat apparatuses and corner posts while having the aesthetic appeal provided by the boards 420 and aluminum frames 410.

Figure 5:
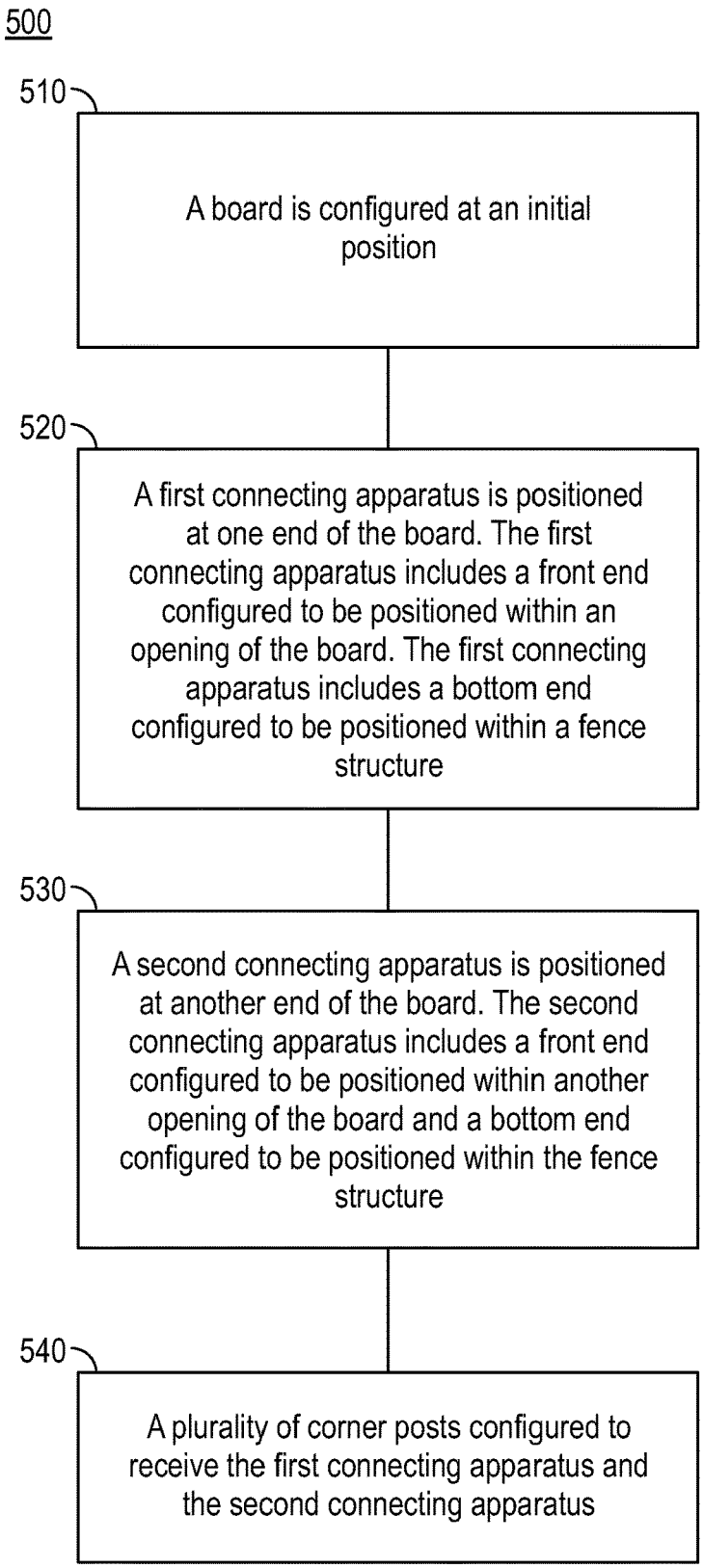
FIG. 5 illustrates a flowchart in accordance with an embodiment of the invention.

Referring to FIG. 5, a method 500 is described for putting together the fence system. The fence system with an initial board connected to a board cleat apparatus on each end of the board. The board cleat apparatus and board that are connected are positioned within each corner post within the fence system. The board cleat apparatus will enable additional boards to be positioned horizontally in between each corner post within the fence system.

In FIG. 5, at step 510, a board is positioned at an initial position. The hoard will including an opening at each end of the board. The opening within the board is configured to receive a board cleat apparatus. Each end of the board will have an opening that is configured to receive a board cleat apparatus.

Referring to FIG. 5, at step 520, a first connecting apparatus is positioned at one end of the board. The first connecting apparatus is a board cleat apparatus. The hoard cleat apparatus includes a front end, a back end, and also a bottom end. The front end of the board cleat apparatus is configured to be positioned within the opening of the board on one end of the board. The hoard cleat apparatus includes the back end and the bottom end. The back end and the bottom end of the board cleat apparatus are configured to be positioned within the fence structure. The back end and bottom end of the board cleat apparatus will be positioned within a corner post within the fence structure. More specifically, the board cleat apparatus will be connected to the board, and the connected board cleat apparatus and board will be positioned within a corner post. The corner post will include a front set of ribs and back set of ribs. The interconnected board cleat apparatus and board will be positioned within the front set of ribs and back set of ribs within the corner post. Moreover, the board cleat apparatus can be positioned onto a back end of the corner post while the front portion of the board is positioned within the front set of ribs and back set of ribs.

In FIG. 5, at step 530, a second connecting apparatus is positioned at another end of the board. The second connecting apparatus is another board cleat apparatus. The other board cleat apparatus is positioned at another end of the board. The other board cleat apparatus is configured to be placed within the opening on the other end of the board. The front end of the other board cleat apparatus is positioned within the opening on the other end of the board. The interconnected board and board cleat apparatus are positioned within a corner post on the other end of the fence system. The other corner post will be configured similarly to the corner post at the other end. The other corner post will also include a front set of ribs and back set of ribs. The interconnected board and board cleat apparatus will be positioned within the back and front set of ribs within the corner post in a substantially similar manner as that described in step 520.

Referring to FIG. 5, at step 540, a plurality of corner posts will be configured to receive the first connecting apparatus and the second connecting apparatus. As mentioned above, the first connecting apparatus and the second connecting apparatus are a respective board cleat apparatus. Each board cleat apparatus is positioned within an opening of the board. Both of the interconnected board cleat apparatus' and board are positioned within a respective corner post. Each respective corner post includes a front set of ribs and back set of ribs. Both board cleat apparatuses and a front portion of both ends of the board are positioned within the front and back set of ribs within each corner post. The board cleat apparatus on both ends of the board enable the board, and additional boards to be placed within the corner posts. The front portion of each board cleat apparatus will connect to an opening of the board. The back end and bottom end of the board cleat apparatus will be used to position the interconnected structure of the board cleat apparatus within each corner post.

ADVANTAGES/SUMMARY

In summary, the board cleat apparatus can enable the boards to be positioned within the fence system. The fence system will include corner posts that receive interconnected boards and a respective board cleat apparatus that is positioned within an opening at an end of the board. Additional boards can be positioned underneath the top board in between each corner post. A top aluminum frame can be positioned on top of the boards after each board is secured within fence system. The entire fence system can have aesthetic appeal due to the boards and the overlying aluminum frames. In addition, the fence system will have the structural support for the boards provided by the board cleat apparatuses, the corner posts, and the aluminum frames.

In recap, a board can have an opening at each of its ends. The opening at each end of the board is configured to receive a front end of a board cleat apparatus. As a result, a respective board cleat apparatus is positioned at each end of the board within an opening of the board. The front end of the board cleat apparatus is positioned within an opening of the board. The back end and bottom end of each board cleat apparatus can be positioned within a corner post within the fence system.

Corner posts can be positioned within the fence system. The corner posts will include a plurality of ribs. Typically, the corner posts will include a front set of ribs and a back set of ribs. The back set of ribs will be positioned behind the front set of ribs within each corner post. Each corner post will also include a back end. The interconnected board and board cleat apparatus can be positioned within each corner post. The back end and bottom portion of the board cleat apparatus will be positioned within the front set of ribs and back set of ribs. Further, the back end and bottom portion of the board cleat apparatus can also be positioned on the back end of the corner post. The front portion of the board will also be positioned within the front set and back set of ribs within each corner post. The other portion of the board will be positioned between each corner post within the fence system.

Once one end of the board has been secured within a corner post, the other end of the board can also be secured within the corner post at the opposite end within the fence system. Another board cleat apparatus will be placed within an opening at the other end of the board. In addition, the back end of the other board cleat apparatus will be placed within the corner post at the opposite end within the fence system. As such, the back end of the other board cleat apparatus and a front portion of the other end of the board will be positioned within the corner post at the opposite end. Additional boards can also be placed underneath the original board. Each board will be configured horizontally within the fence system.

The top aluminum rail can be placed over the boards within the fence system to complete the fence system. Users can determine the length of the fence system, and how many corner posts, and thereby boards and board cleat apparatuses are required. The top aluminum rail can provide structural support for the boards and the corner posts.

The board cleat apparatuses within the fence system enable the boards to be positioned within each corner post. The front portion of each board cleat apparatus is able to connected to the board and be interconnected with the board. The back portion of the board cleat apparatus and bottom portion of the board cleat apparatus will be positioned within the front set of ribs and back set of ribs within the respective corner post. The back end and bottom end of the board cleat apparatus can also be in contact with the back end of the corner post. The front portion of the respective board that is connected to the respective board cleat apparatus will thereby also be positioned within the front set of ribs and back set of ribs within the respective corner post. Each board cleat apparatus within the fence system enables all of the boards to be secured within the fence system and also provides structural support for the boards as well. The overall aesthetic appeal of the fence system is enhanced with the boards, with the structural support being provided by the board cleat apparatuses, corner posts, and aluminum rails.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

While the foregoing is directed to embodiments of the present disclosure, other and further embodiments of the present disclosure may be devised without departing from the basic scope thereof. It is understood that various embodiments described herein may be utilized in combination with any other embodiment described, without departing from the scope contained herein. Further, the foregoing description is not intended to be exhaustive or to limit the disclosure to the precise form disclosed.

Modifications and variations are possible in light of the above teachings or may be acquired from practice of the disclosure. Certain exemplary embodiments may be identified by use of an open-ended list that includes wording to indicate that the list items are representative of the embodiments.

The invention claimed is:

1. A system comprising:

a board configured at an initial position;

a first connecting apparatus positioned at one end of the board, wherein the first connecting apparatus includes a first front end that is configured to be positioned within an opening of the board, and a first back end configured to be positioned within an inner channel of a first post of a fence structure;

a second connecting apparatus positioned at a second end of the board, wherein the second connecting apparatus includes a second front end configured to be positioned within a second opening of the board, and a second back end configured to be positioned within an inner channel of a second post of the fence structure; and wherein the first post further comprises a first pair of ribs and a second pair of ribs protruding from an inner surface of the inner channel of the first post, wherein the first connecting apparatus is positioned behind the second pair of ribs within the inner channel of the first post.

2. The system of claim 1, wherein first post is configured to receive the board connected to the first connecting apparatus, wherein the board is received by the second pair of ribs protruding from the inner surface.

3. The system of claim 1, wherein the board consists of aluminum material.

4. The system of claim 1, wherein the board is positioned horizontally within the fence structure.

5. The system of claim 1, wherein the first connecting apparatus is a board cleat apparatus.

6. The system of claim 1, wherein a back end of the first connecting apparatus is secured within the first post.

7. A system comprising:

a board configured at a first position;

a connecting apparatus configured at a second position, wherein the connecting apparatus includes a front end and a back end, wherein the front end is configured to be positioned within a front portion of the board, and wherein the back end is configured to be positioned within a fence structure; and a corner post positioned within the fence structure, wherein the corner post includes a front set of ribs protruding from an inner surface of an inner channel and a back set of ribs protruding from the inner surface and positioned to receive the back end of the connecting apparatus.

8. The system of claim 7, wherein the front end of the connecting apparatus is positioned in an opening within the board.

9. The system of claim 7, wherein the board is partially positioned within a front portion of the corner post.

10. The system of claim 7, further comprising:

a second corner post positioned at a second end of the board to receive another connecting apparatus.

11. The system of claim 7, further comprising:

a second connecting apparatus positioned on a second end of the board to connect the board to the fence structure.

12. The system of claim 7, further comprising:

a plurality of additional boards made of aluminum materials positioned underneath the board within the fence structure.

13. The system of claim 7, wherein the back set of ribs within the corner post secures the connecting apparatus within the fence structure.

14. A method comprising:

configuring a board at an initial position;

positioning a first connecting apparatus at one end of the board, wherein the first connecting apparatus includes a first front end configured to be positioned within an opening of the board, and a first back end configured to be positioned within an inner channel of a first post of a fence structure;

configuring a second connecting apparatus at a second end of the board, wherein the second connecting apparatus includes a front end configured to be positioned within a second opening of the board, and a second back end configured to be positioned within an inner channel of a second post of the fence structure;

positioning the first post and the second post to receive the first connecting apparatus and the second connecting apparatus, respectively; and wherein the first post further comprises a first pair of ribs and a second pair of ribs protruding from an inner surface of the inner channel of the first post, wherein the first connecting apparatus is positioned behind the second pair of ribs within the inner channel of the first post.

15. The method of claim 14, wherein the second connecting apparatus is configured in a position opposite to the first connecting apparatus to be received in the second end of the board.

16. The method of claim 14, further comprising:

positioning the second connecting apparatus into the second post.

17. The method of claim 14, wherein the first connecting apparatus is positioned behind the first pair of ribs within the first post.

18. The method of claim 14, further comprising:

positioning one or more additional boards within the first and second corner posts.

19. The method of claim 14, further comprising:

positioning a top rail over the board after the board is configured within the first post and second post.

* * * * *